US009562700B2

(12) United States Patent
Watanabe

(10) Patent No.: US 9,562,700 B2
(45) Date of Patent: Feb. 7, 2017

(54) USE-SIDE UNIT AND AIR CONDITIONER

(75) Inventor: Yoshiyuki Watanabe, Tokyo (JP)

(73) Assignee: MITSUBISHI ELECTRIC CORPORATION, Chiyoda-ku, Tokyo (JP)

( * ) Notice: Subject to any disclaimer, the term of this patent is extended or adjusted under 35 U.S.C. 154(b) by 274 days.

(21) Appl. No.: 13/142,873

(22) PCT Filed: Feb. 20, 2009

(86) PCT No.: PCT/JP2009/052947

§ 371 (c)(1),
(2), (4) Date: Jun. 30, 2011

(87) PCT Pub. No.: WO2010/095238

PCT Pub. Date: Aug. 26, 2010

(65) Prior Publication Data

US 2011/0276185 A1 Nov. 10, 2011

(51) Int. Cl.
*F24F 3/153* (2006.01)
*F24F 11/08* (2006.01)
(Continued)

(52) U.S. Cl.
CPC ..... *F24F 3/153* (2013.01); *F24F 11/0008* (2013.01); *F24F 11/0012* (2013.01); *F24F 11/0015* (2013.01); *F24F 2003/1446* (2013.01)

(58) Field of Classification Search
USPC ..... 700/278; 62/56, 79
See application file for complete search history.

(56) References Cited

U.S. PATENT DOCUMENTS 4,089,667 A * 5/1978 Jonsson ..... 62/238.6
4,182,131 A * 1/1980 Marshall et al. ..... 62/91
(Continued)

FOREIGN PATENT DOCUMENTS

CN 1109156 A 9/1995
JP 5-223316 A 8/1993
(Continued)

OTHER PUBLICATIONS

Trane, "Engineers Newsletter—Better Part-Load Dehumidification: It's not a pipe dream", 2004, vol. 33-2.*
(Continued)

*Primary Examiner* — Mohammad Ali
*Assistant Examiner* — Kelvin Booker
(74) *Attorney, Agent, or Firm* — Buchanan Ingersoll & Rooney PC

(57) ABSTRACT

A use-side unit and an air conditioner that can feed out air at a target temperature into a target space are provided. A use-side evaporator that recovers moisture obtained by cooling and condensing the air to be fed out into the space to be air-conditioned or the like and dehumidifies it so as to obtain target relative humidity, a use-side condenser that heats the air having passed through the use-side evaporator by heat exchange, adjusts it to a target dry-bulb temperature and feeds it out into the space to be air-conditioned or the like, and a use-side controller that calculates a correction value if a difference between a dry-bulb temperature according to the detection of a temperature detector that detects a dry-bulb temperature of the air to be fed out into the target space and the target dry-bulb temperature is larger than a predetermined value and performs processing to correct a target intermediate dry-bulb temperature.

9 Claims, 6 Drawing Sheets

(51) Int. Cl.
*F24F 11/00* (2006.01)
*F24F 3/14* (2006.01)

(56) References Cited

U.S. PATENT DOCUMENTS 4,373,346 A * 2/1983 Hebert et al. ..... 62/79
4,377,074 A * 3/1983 Jardine ..... 62/183
4,483,154 A * 11/1984 Smeal ..... F03G 7/00 62/235.1
4,557,116 A * 12/1985 Kittler ..... F24F 3/153 62/238.6
5,168,754 A * 12/1992 Erbs ..... F24F 11/0012 374/10
5,181,552 A * 1/1993 Eiermann ..... F24F 3/153 165/228
5,193,352 A * 3/1993 Smith et al. ..... 62/90
5,228,302 A * 7/1993 Eiermann ..... F25B 29/003 62/173
5,309,725 A * 5/1994 Cayce ..... F24F 3/1405 62/173
5,329,782 A * 7/1994 Hyde ..... F24F 3/153 62/176.5
5,390,505 A * 2/1995 Smith et al. ..... 62/173
5,493,871 A * 2/1996 Eiermann ..... F24F 3/153 62/173
5,509,272 A * 4/1996 Hyde ..... F24F 3/153 62/176.5
5,517,828 A * 5/1996 Calton ..... F24F 3/1411 62/271
5,551,245 A * 9/1996 Calton ..... F24F 3/1411 62/271
5,564,281 A * 10/1996 Calton ..... F24F 3/1411 62/271
5,595,000 A * 1/1997 Goodwin, III ..... F26B 21/086 34/212
5,622,057 A * 4/1997 Bussjager ..... F24F 3/153 62/173
5,649,428 A * 7/1997 Calton ..... F24F 3/1411 62/94
5,651,264 A * 7/1997 Lo et al. ..... 62/230
5,666,813 A * 9/1997 Brune ..... F24F 3/153 62/510
5,675,979 A * 10/1997 Shah ..... F24F 11/0008 165/223
5,737,934 A * 4/1998 Shah ..... F24F 11/0008 165/223
5,775,580 A * 7/1998 Sizemore ..... B60H 1/3202 165/222
5,802,862 A * 9/1998 Eiermann ..... F24F 3/14 165/228
6,012,296 A * 1/2000 Shah ..... F24F 3/153 165/228
6,070,110 A * 5/2000 Shah et al. ..... 700/278
6,129,285 A * 10/2000 Schafka ..... B05B 15/1222 165/226
6,131,653 A * 10/2000 Larsson ..... F24F 3/14 165/224
6,170,271 B1 * 1/2001 Sullivan ..... F24F 3/153 62/176.1
6,205,797 B1 * 3/2001 Maeda ..... 62/94
6,269,650 B1 * 8/2001 Shaw ..... F24F 11/008 236/44 C
6,311,511 B1 * 11/2001 Maeda ..... 62/271
6,427,454 B1 * 8/2002 West ..... F24F 3/153 62/176.1
6,442,951 B1 * 9/2002 Maeda et al. ..... 62/94
6,499,308 B2 * 12/2002 Inoue et al. ..... 62/228.3
6,694,757 B1 * 2/2004 Backman ..... F24F 3/153 62/173
7,018,558 B2 * 3/2006 Schnur et al. ..... 252/68
7,139,564 B2 * 11/2006 Hebert ..... H04L 29/06 455/423
7,606,683 B2 * 10/2009 Bahel et al. ..... 703/1
7,890,215 B2 * 2/2011 Duncan ..... 700/276
7,908,126 B2 * 3/2011 Bahel et al. ..... 703/6
7,975,495 B2 * 7/2011 Voorhis et al. ..... 62/176.6
8,406,929 B2 * 3/2013 Duncan ..... 700/277
2001/0019120 A1 * 9/2001 Schnur et al. ..... 252/68
2002/0026803 A1 * 3/2002 Inoue et al. ..... 62/228.3
2003/0047707 A1 * 3/2003 Schnur et al. ..... 252/68
2003/0121271 A1 * 7/2003 Dinnage ..... F24F 3/1405 62/94
2004/0118133 A1 * 6/2004 Maeda et al. ..... 62/93
2004/0140364 A1 * 7/2004 Curtis, Sr. ..... B60H 1/00785 237/12
2004/0144106 A1 * 7/2004 Douglas ..... F25B 49/02 62/127
2005/0165591 A1 * 7/2005 Bahel et al. ..... 703/7
2005/0166618 A1 * 8/2005 Bussjager ..... F24F 3/153 62/196.4
2005/0166620 A1 * 8/2005 Bussjager ..... F24F 3/153 62/196.4
2006/0137369 A1 * 6/2006 Galante ..... F25B 45/00 62/149
2006/0259285 A1 * 11/2006 Bahel et al. ..... 703/7
2007/0017113 A1 * 1/2007 Scharpf ..... F26B 21/086 34/86
2007/0169372 A1 * 7/2007 Scharpf ..... F26B 3/20 34/468
2008/0098756 A1 * 5/2008 Uselton ..... F24F 3/153 62/173
2008/0116289 A1 * 5/2008 Lochtefeld ..... F24F 3/06 237/81
2008/0127661 A1 * 6/2008 Bhatti et al. ..... 62/171
2008/0196425 A1 * 8/2008 Temple ..... F25B 49/00 62/172
2009/0171512 A1 * 7/2009 Duncan ..... 700/300
2010/0000243 A1 * 1/2010 Morimoto ..... F24F 1/022 62/176.6
2010/0043453 A1 * 2/2010 Mak ..... 62/50.2
2010/0107668 A1 * 5/2010 Voorhis et al. ..... 62/176.3
2010/0127089 A1 * 5/2010 Sakami ..... 236/44 C
2010/0170273 A1 * 7/2010 Morimoto et al. ..... 62/176.6
2010/0269520 A1 * 10/2010 Moore ..... 62/89
2010/0269521 A1 * 10/2010 Moore ..... 62/91
2011/0120693 A1 * 5/2011 Kammerzell et al. ..... 165/201
2011/0137468 A1 * 6/2011 Duncan ..... 700/277
2012/0011865 A1 * 1/2012 Ivison ..... 62/79
2012/0047930 A1 * 3/2012 Uselton ..... F24D 11/0242 62/176.6
2012/0078424 A1 * 3/2012 Raghavachari ..... 700/282
2012/0247135 A1 * 10/2012 Fakieh ..... 62/129
2013/0062047 A1 * 3/2013 Vaney et al. ..... 165/287
2013/0239814 A1 * 9/2013 Ito et al. ..... 96/111

FOREIGN PATENT DOCUMENTS

JP 8-005131 A 1/1996
JP 2001-091097 A 4/2001
JP 2004-132572 A 4/2004
JP 2006-118822 A 5/2006

OTHER PUBLICATIONS

Trane, "Applications Engineering Manual—Dehumidification in HVAC Systems", Dec. 2002, SYS-APM004-EN.*
International Search Report (PCT/ISA/210) issued on May 26, 2009, by Japanese Patent Office as the International Searching Authority for International Application No. PCT/JP2009/052947.
Chinese Office Action dated May 21, 2013, issued issued by the Chinese Patent Office in corresponding Chinese Patent Application No. 200980156860.1, and English language translation of Office Action. (14 pages).
Jan. 13, 2014 Chinese Office Action issued in Chinese Patent Application No. 200980156860.1.

* cited by examiner

| NO. | OPERATION |
|---|---|
| (1) | HEATING/HUMIDIFICATION |
| (2) | HUMIDIFICATION |
| (3) | COOLING/HUMIDIFICATION |
| (4) | HEATING |
| (5) | TARGET TEMPERATURE/HUMIDITY |
| (6) | COOLING/DEHUMIDIFICATION |
| (7) | HEATING/DEHUMIDIFICATION |
| (8) | DEHUMIDIFICATION |
| (9) | COOLING/DEHUMIDIFICATION |

USE-SIDE UNIT AND AIR CONDITIONER

TECHNICAL FIELD

The present invention relates to a use-side unit that performs air conditioning in a reheating method so that a space to be air-conditioned or the like is made to have a set temperature and a set humidity, for example, and an air conditioner using the same.

BACKGROUND ART

In an air conditioner, a heat-source-side unit (outdoor unit) having a compressor and an outdoor heat exchanger (heat-source-side heat exchanger) and a use-side unit (indoor unit) having a throttle device to be used as an expansion valve and a use-side heat exchanger (load-side heat exchanger) are connected by a pipeline so as to form a refrigerant circuit. By circulating a fluid such as a refrigerant to become a heat conveying medium, heat exchange is performed in the indoor unit with air in a target space for which air conditioning, ventilation or the like are performed (hereinafter referred to as a space to be air-conditioned or the like) so as to regulate the temperature of the space to be air-conditioned or the like.

Also, not only the temperature (unless specified otherwise, the temperature hereinafter refers to a dry-bulb temperature, a temperature value and temperature data are also referred to as a temperature) but also humidity (unless specified otherwise, the humidity hereinafter to refers to a relative humidity. Also, a value and data on the humidity are also referred to as humidity) are required to be regulated. Thus, an air conditioner of a reheat type in which, after sucked air is cooled to a dew-point temperature according to set humidity and condensed and dehumidified, the air is heated again to a predetermined temperature and fed out to the space to be air-conditioned or the like is known (See Patent Document 1, for example). A use-side unit in this type of air conditioner has, as a use-side heat exchanger, a heat exchanger that functions as an evaporator (hereinafter referred to as a use-side evaporator) and a heat exchanger that functions as a condenser to become a reheating device (hereinafter referred to as a use-side condenser), for example. A configuration is adopted such that the use-side evaporator heats the air having been dehumidified by the use-side evaporator through cooling so as to obtain a set humidity to a target temperature so that the space to be air-conditioned or the like is made to have a set temperature and feeds out (blows out) the air into the space to be air-conditioned or the like, for example.

[Patent Document 1] Japanese Unexamined Patent Application Publication No. 2001-91097

DISCLOSURE OF INVENTION

Problems to be Solved by the Invention

However, there might be a case in which a dew-point temperature is high due to its relationship with the set humidity and the temperature of the air on the secondary side (blow-out, discharge side) of the use-side evaporator is high or a case in which a set temperature is low, for example. At this time, in the reheating device, it might be (minimum heating amount of reheating device)>(required heating amount acquired from a difference between the target temperature and the temperature of the air on the primary side (sucking, suction side) of the use-side condenser), for example. Thus, in the prior-art air conditioner of the reheating method, the air of a temperature higher than the target temperature might be blown out (fed out) to the space to be air-conditioned or the like due to heating of the air by the reheating device.

The present invention was made in order to solve the above problem and has an object to provide a use-side unit that can feed out air at a target temperature corresponding to a set temperature into a space to be air-conditioned or the like and an air conditioner.

Means for Solving the Problems

A use-side unit according to the present invention is provided with an evaporator that recovers moisture obtained by cooling and condensing air to be fed out into a space to be air-conditioned or the like by heat exchange and performs dehumidification, a condenser that heats the air having passed through the evaporator by heat exchange and feeds out into the space to be air-conditioned or the like, a first temperature detector that detects a dry-bulb temperature of the air to be fed out into the space to be air-conditioned or the like, and a controller that determines a target intermediate dry-bulb temperature to be made to have a target dry-bulb temperature of the air having passed through the evaporator on the basis of the target dry-bulb temperature and target relative humidity and if it is determined that a difference between the dry-bulb temperature according to detection of the first temperature detector and the target dry-bulb temperature is larger than a predetermined value, a correction value is calculated on the basis of the difference between the dry-bulb temperature according to the detection of the first temperature detector and the target dry-bulb temperature and performs processing to correct the target intermediate dry-bulb temperature on the basis of the correction value.

Advantages

In the use-side unit according to the present invention, if it is determined that the difference between the dry-bulb temperature according to the detection of the first temperature detector and the target dry-bulb temperature is larger than the predetermined value, control is made so that the target intermediate dry-bulb temperature is corrected by the calculated correction value and the temperature of the air having passed through the evaporator is lowered, and even if minimum condensation capability of the condenser is high, for example, the temperature and humidity of the air to be blown out into the space to be air-conditioned or the like can be brought close to the target temperature and target humidity.

REFERENCE NUMERALS

1 use-side evaporator unit, 2 blower, 3 use-side evaporator,

4 use-side condenser, 5 evaporation-side controller, 5A evaporation-side processing means, 5B evaporation-side storage means,

6 condensation-side controller, 6A condensation-side processing means,

6B condensation-side storage means, 7, 8 temperature detector, 9 humidity detector, 10 evaporation-side control valve, 11 condensation-side control valve, 12, 13 pipeline, 14 sucked air, 15, 16 blown-out air, 17 remote controller,

18 use-side condenser unit, 100 heat-source-side unit, 101 compressor, 102 oil separator, 103 heat-source-side condenser, 104 heat-source-side fan, 105 accumulator, 111 heat-source-side controller, 200 use-side unit.

BEST MODES FOR CARRYING OUT THE INVENTION

Embodiment 1

Figure 1:
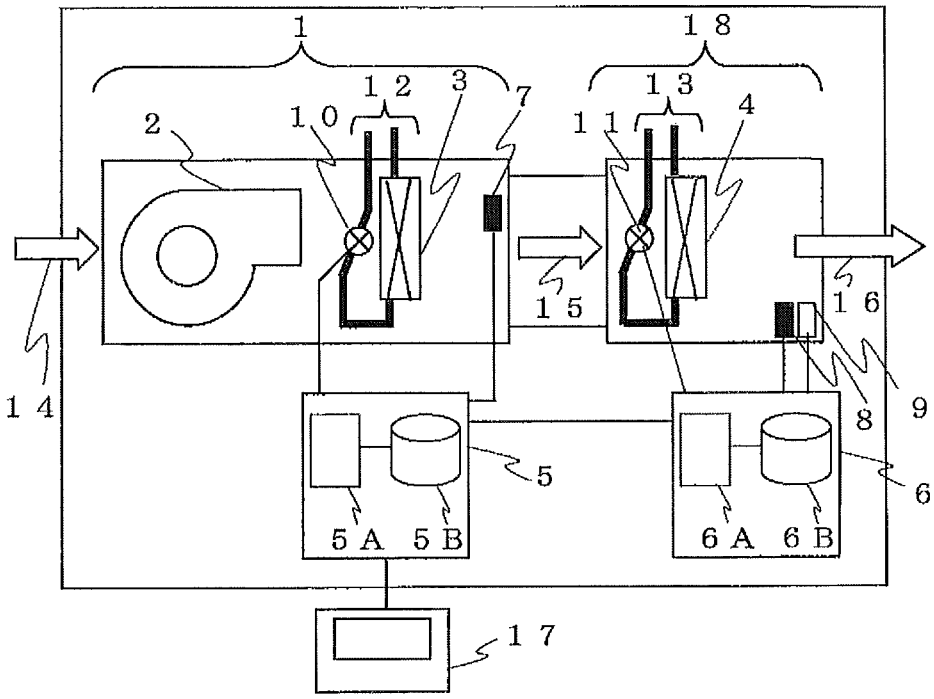
FIG. 1 is a diagram illustrating a configuration of a use-side unit in Embodiment 1.

FIG. 1 is a diagram illustrating a configuration of a use-side unit of an air conditioner according to Embodiment 1 of the present invention. The use-side unit in FIG. 1 has a use-side evaporator unit 1, a use-side condenser unit 18, and a remote controller 17. In the use-side unit, blown-out air 15 sucked by the use-side evaporator unit 1 from the primary side as sucked air 14 and blown out from the secondary side passes from the primary side to the secondary side of the use-side condenser unit 18 and is blown out (fed out) as blown-out air 16 into a space to be air-conditioned or the like.

The use-side evaporator unit 1 of this embodiment has a blower 2, a use-side evaporator 3, an evaporation-side control valve 10, and an evaporation-side controller 5. The blower 2 is to form a flow of air to be blown out into the space to be air-conditioned or the like by adjusting the humidity and temperature of the sucked air. In the use-side unit, the flow of air formed by the blower 2 is the primary side of the use-side evaporator unit 1 (use-side evaporator 3)→the secondary side of the use-side evaporator unit 1 (use-side evaporator 3) (the primary side of the use-side condenser unit 18 (use-side condenser 4))→the secondary side of the use-side condenser unit 18 (use-side condenser 4).

The use-side evaporator 3 exchanges heat between a heat conveying medium (fluid) such as a refrigerant flowing through a pipeline 12 and the air flowing in from the primary side of the use-side evaporator unit 1. As a result, the air having flowed in from the primary side is cooled, and moisture in the air is condensed and recovered so as to be dehumidified and is made to flow out of the secondary side. The evaporation-side control valve 10 is a valve that controls evaporation capability of the use-side evaporator 3 by controlling a flow rate and a pressure of the fluid flowing through the use-side evaporator 3 by changing an opening-degree. In this embodiment, the valve is assumed to be an electric valve that can electrically control the opening-degree by passing an electric current or the like and driving a motor.

The evaporation-side controller 5 transmits a signal including instructions and the like to devices and means constituting the use-side evaporator unit 1 and controls them. Thus, in this embodiment, the evaporation-side controller 5 has evaporation-side processing means 5A that performs processing according to control and evaporation-side storage means 5B that stores data, a program and the like required for the evaporation-side processing means 5A to perform processing. Also, the controller 5 is provided with communication means (not shown), for example, so that communication using a signal including various data and the like can be conducted with the condensation-side controller 6 or the control can be made in a coordinated manner. In this embodiment, a target temperature Tm and target humidity hm of the blown-out air 16 are determined from a set temperature and set humidity according to setting made by a user, and moreover, a target intermediate temperature T1*m* is determined. In order to make the temperature of the blown-out air 15 the target intermediate temperature, the opening-degree of the evaporation-side control valve 10 is controlled. Here, in this embodiment, description will be made assuming that the set temperature and the target temperature Tm, and the set humidity and the target humidity hm are different from each other, respectively. However, if the temperature and humidity of the space to be air-conditioned or the like are detected by the temperature detector 8 and the humidity detector 9, for example, they may be handled as the same temperature and humidity.

Also, the use-side condenser unit 18 of this embodiment has the use-side condenser 4, the condensation-side control valve 11, and the condensation-side controller 6. The use-side condenser 4 exchanges heat between the refrigerant flowing through the pipeline 13 and air from the primary side of the use-side condenser unit 18. As a result, the air from the primary side having been cooled once by the use-side evaporator unit 1 is heated again (reheated) and discharged from the secondary side. The condensation-side control valve 11 is a valve that controls the condensation capability of the use-side condenser 4 by controlling the refrigerant amount flowing through the use-side condenser 4 and the pressure by changing the opening-degree. The condensation-side control valve 11 is also assumed to be an electric valve whose opening-degree can be electrically adjusted.

The condensation-side controller 6 controls each device constituting the use-side condenser unit 18. The condensation-side controller 6 is also assumed to have the condensation-side processing means 6A and the condensation-side storage means 6B similarly to the evaporation-side controller 5. The condensation-side controller 6 of this embodiment transmits signals including data on the temperature and humidity of the blown-out air 16 according to detection of the temperature detector 8 and the humidity detector 9 so that the evaporation-side controller 5 performs processing, for example. Also, the opening-degree of the condensation-side control valve 11 is controlled so that the temperature of the blown-out air 16 is made to have the target temperature determined by the evaporation-side controller 5.

Here, the fluid (heat conveying medium) flowing through the use-side evaporator 3 and the use-side condenser 4 through the pipelines 12 and 13 is assumed to be a refrigerant such, as R410A in this embodiment. However, the medium is not limited to the refrigerant but may be water, brine or the like. In the case of the refrigerant, the evaporation-side control valve 10 and the condensation-side control valve 11 each act as a throttle device. In the case of water or brine, each acts as a flow-rate control valve.

Figure 2:
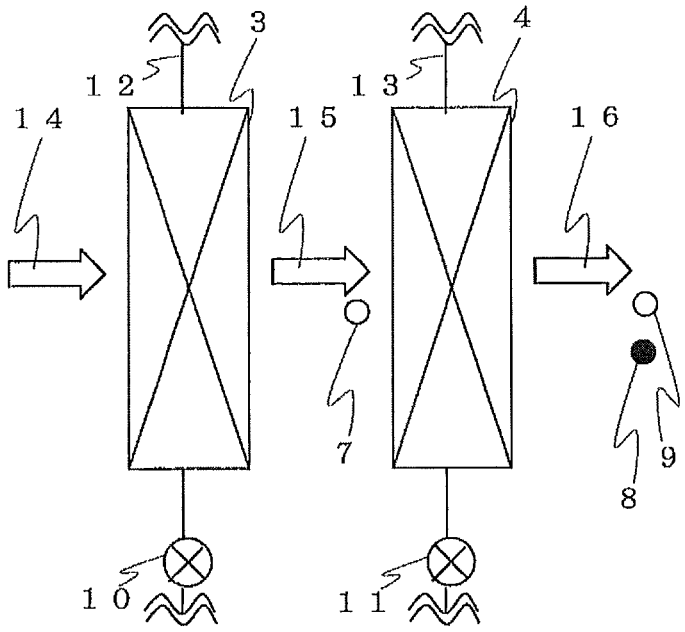
FIG. 2 is a diagram illustrating an example of a layout relationship of detectors.

FIG. 2 is a diagram illustrating an example of a layout relationship of the temperature detector 7, the temperature detector 8, and the humidity detector 9. The temperature detector 7, which is a second temperature detector, detects the temperature of the blown-out air 15 (air entering the primary side of the use-side condenser unit 18) from the secondary side of the use-side evaporator unit 1 and transmits a signal based on the temperature to the evaporation-side controller 5. Also, the temperature detector 8, which is a first temperature detector, detects the temperature of the blown-out air 16 coming out of the secondary side of the use-side condenser unit 18 and transmits a signal based on the temperature to the condensation-side controller 6. The humidity detector 9 detects the humidity of the blown-out air 16 coming out of the secondary side of the use-side condenser unit 18 and transmits a signal based on the humidity to the condensation-side controller 6. Thus, in this embodiment, the temperature detector 8 and the humidity detector 9 are disposed at a blow-out port, a blow-out duct and the like in the use-side condenser unit 18. However, the places where the temperature detector 8 and the humidity detector 9 are disposed are not limited to those places. For example, they may be disposed at positions outside the use-side condenser unit 18 in order to detect the temperature and humidity of the space to be air-conditioned or the like.

Moreover, in FIG. 1, the flow of air by the use-side unit is indicated as the sucked air 14 sucked in from the primary side of the use-side evaporator 3, the blown-out air 15 blowing out of the secondary side of the use-side evaporator 3, and the blown-out air 16 coming out of the secondary side of the use-side condenser 4. Here, as for the sucked air 14, the blown-out air 15, and the blown-out air 16, since the sucked air 14 is air before dehumidification, its humidity is higher than the blown-out air 15 and the blown-out air 16. Also, since the blown-out air 15 is air cooled by the use-side evaporator 3 when being dehumidified, its temperature is basically lower than the sucked air 14 and the blown-out air 16. The blown-out air 15 is the air heated by the use-side condenser 4. The sucked air 14 may suck outdoor air (outside air) in order to ventilate the space to be air-conditioned or the like or may be the air (indoor air) of the space to be air-conditioned or the like. Also, the outside air and the indoor air may be sucked in a certain ratio so that ventilation and air conditioning are performed for the space to be air-conditioned or the like.

The remote controller 17 transmits a signal based on an instruction inputted by a user to the evaporation-side controller 5. Also, though not particularly shown here, if display means or the like is provided, for example, a display or the like on the basis of the signal transmitted from the evaporation-side controller 5 is made. In this embodiment, particularly signals according to a set temperature and a set humidity according to an input by a user are transmitted to the evaporation-side controller 5. Here, a method of setting the temperature and humidity by the remote controller 17 is not particularly limited. For example, numerical values of the temperature and humidity may be inputted by a user. Also, as for the humidity, for example, strict management as that for temperature does not have to be made in some cases. Thus, a switch for high humidity and low humidity may be provided, for example, so that a user can switch the humidity.

On the basis of the set temperature and set humidity transmitted from the remote controller 17, the evaporation-side controller 5 (evaporation-side processing means 5A) determines the target temperature Tm and the target humidity hm. Also, on the basis of the target temperature Tm and the target humidity hm, conversion is made to a target dew-point temperature Tdwm (temperature in a state in which absolute humidity at the target temperature Tm and the target humidity hm is made to have a relative humidity of 100%). Then, in this embodiment, the target dew-point temperature Tdwm is determined as a target intermediate temperature T1*m* of the blown-out air 15. Then, the opening-degree of the evaporation-side control valve 10 is controlled on the basis of the temperature according to detection of the temperature detector 7 so that the blown-out air 15 is made to have the target intermediate temperature T1*m*. As for conversion processing on the target dew-point temperature Tdwm, equations and the like on the basis of humidity air diagram are stored as data in the evaporation-side storage means 5B, and the evaporation-side processing means 5A performs calculation processing on the basis of the equations and performs conversion to the target dew-point temperature Tdwm.

In this embodiment, control is performed so that the dehumidification is performed up to the absolute humidity that is made to have the target humidity hm at the target temperature Tm. After that, if the temperature of the blown-out temperature 16 exceeds a predetermined range and becomes higher than the target temperature Tm, the target intermediate temperature T1*m* is corrected so as to lower the temperature of the blown-out temperature 15 so that the temperature of the blown-out temperature 16 is made to have the target temperature Tm. At this time, humidity is decreasing. However, if the humidity is not particularly high, a difference in temperature (air temperature) is felt more sensitively than humidity, and the temperature is basically given priority over the humidity even if the humidity decreases so as to be brought close to the target, and a comfortable level of air conditioning is sought.

Figure 3:
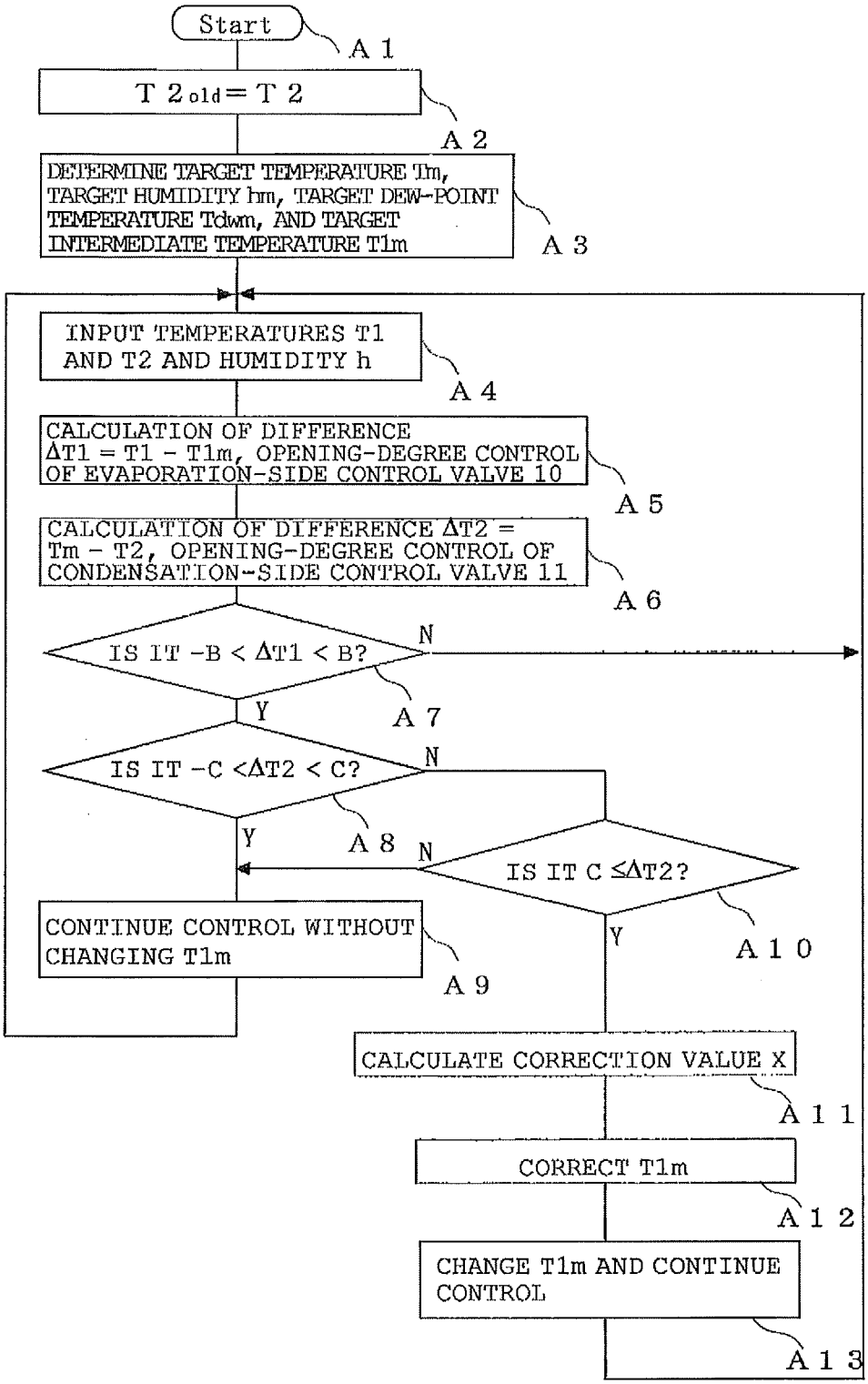
FIG. 3 is a diagram illustrating a flowchart indicating control contents in Embodiment 1.

FIG. 3 is a diagram illustrating a flowchart of processing according to control of air conditioning of the space to be air-conditioned or the like mainly by the evaporation-side controller 5 and the condensation-side controller 6 according to Embodiment 1. In this embodiment, description will be made assuming that the evaporation-side controller 5 (evaporation-side processing means 5A) mainly executes processing according to control in FIG. 3, and the condensation-side controller 6 (condensation-side processing means 6A) mainly executes processing according to control of the condenser-side unit 18 on the basis of the determination and the like of the evaporation-side controller 5. However, role sharing or the like according to control is not limited to this assumption. First, when the control is started (A1), a temperature $T2_{old}$ detected by the temperature detector 8 at a previous time is set as a temperature T2 according to detection of the temperature detector 8 (A2).

Then, the evaporation-side controller 5 determines the target temperature Tm and the target humidity hm of the blown-out air 16 on the basis of the set temperature and the set humidity set by the user through the remote controller 17. Moreover, on the basis of the target temperature Tm and the target humidity hm, the target dew-point temperature Tdwm is determined and set as the target intermediate temperature T1*m* of the blown-out air 15 (A3). Here, the set temperature and the set humidity may be set as the target temperature Tm and the target humidity hm as they are.

Moreover, the evaporation-side controller 5 inputs the temperature T1 according to the detection of the temperature detector 7, the temperature T2 according to the detection of the temperature detector 8, and humidity h according to the detection of the humidity detector 9 (A4). The difference ΔT1 between the temperature T1 and the target intermediate temperature T1*m* is calculated, and the opening-degree of the evaporation-side control valve 10 is controlled on the basis of the difference ΔT1 (A5). As a result, the evaporation capability of the use-side evaporator 3 is adjusted by adjusting the refrigerant amount flowing through the use-side evaporator 3 and the pressure, and the sucked air 14 is cooled so as to be made to have the target intermediate temperature T1*m*. Then, moisture in the sucked air 14 condensed by cooling is recovered and dehumidified.

On the other hand, the condensation-side controller 6 calculates a difference ΔT2 between the temperature T2 and the target temperature Tm and changes the opening-degree of the condensation-side control valve 11 on the basis of the difference ΔT2 (A5). As a result, the refrigerant amount flowing through the use-side condenser 4 is adjusted, the condensation capability of the use-side condenser 4 is adjusted, and the blown-out air 15 is heated at a predetermined temperature. Also, the condensation-side controller 6 transmits a signal including data on the difference ΔT2 to the evaporation-side controller 5. Here, in the condensation-side controller 6, the difference ΔT2 is calculated, but the calculation may be performed by the evaporation-side controller 5.

Then, the evaporation-side controller 5 compares the temperature T1 with the target intermediate temperature T1*m* and determines whether the difference ΔT1 is within an allowable range (−B<ΔT1<B) or not (A7). Here, reference character B designates a control allowable range constant. If it is determined that the difference is out of the allowable range, it is assumed that the temperature of the blown-out air 15 is not getting close to the target intermediate temperature T1*m*, the routine returns to A4, and processing is continued till the difference falls under the allowable range.

If it is determined that ΔT1 is within the allowable range, then, the evaporation-side controller 5 compares the temperature T2 with the target temperature Tm on the basis of the difference ΔT2 calculated by the condensation-side controller 6 and determines whether the difference is within the allowable range (−C<ΔT2<C) or not (A8). Here, reference character C designates a control allowable range constant. If it is determined that the difference is within the allowable range, it is assumed that the temperature of the blown-out air 16 has reached the target temperature Tm, the operation state is maintained (the operation is performed without changing the target intermediate temperature T1*m*) (A9), and the routine returns to A4 and the processing is performed.

If it is determined that ΔT2 is out of the allowable range, it is further determined whether ΔT2≤−C is true or not (A10). If it is determined that ΔT2≤−C is true, it is only necessary that the blown-out air 15 be heated by the use-side condenser 4, and since the target intermediate temperature T1*m* does not have to be changed, the operation state is maintained (A9), and the routine returns to A4 and the processing is performed. A8 and A10 are performed individually here, but they may be processed at the same time.

If it is determined that ΔT2 is out of the allowable range and ΔT2≤−C (C≤ΔT2) is not true, the evaporation-side controller 5 calculates a correction value X using the following equation(1) on the basis of the detected temperature T2, the target temperature T, and the control allowable range constant C (A11).

$$X=T2-(Tm+C) \quad (1)$$

Moreover, on the basis of the correction value X, the target intermediate temperature T1*m* is corrected on the basis of the following equation (2) (A12). Then, the control is executed with the corrected T1*m* as the new target intermediate temperature T1*m*. The use-side condenser unit 18 is controlled so that the state is maintained (A13).

$$T1m=T1m-X \quad (2)$$

Figure 4:
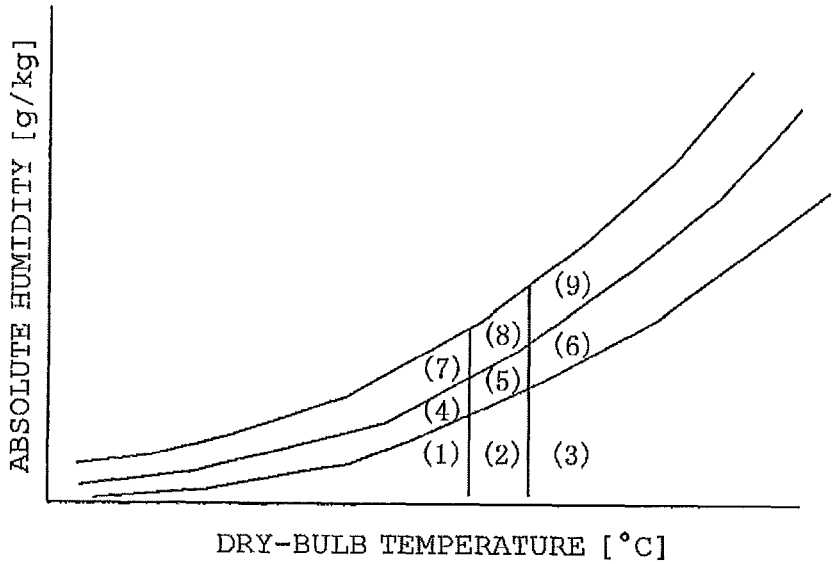
FIG. 4 is a diagram illustrating a relationship between an operation of the air conditioner and an air diagram.

FIG. 4 is a diagram illustrating a relationship between an air diagram showing the temperature and humidity of the sucked air and an operation to be performed. In FIG. 4, (5) indicates a range that can be considered as the target temperature Tm and the target humidity hm. In the ranges of (1), (2), and (3), since humidity is lower than the target humidity hm, humidification is necessary. In the ranges of (7), (8), and (9), humidity becomes higher than the target humidity hm. Thus, dehumidification is performed in the use-side evaporator unit 1 (processing according to A5 to A7 in FIG. 3). As a result, when the range of (4) (the target humidity hm is obtained) is reached, control is executed so as to obtain the range of (5) by performing heating in the use-side condenser unit 18 (processing according to A10 in FIG. 3). Also, if the operation in the range of (6) is reached, control is executed so that the temperature is lowered while the absolute humidity is lowered by correcting the target intermediate temperature T1*m* (processing according to A11 to A13 in FIG. 3).

As described above, in the use-side unit of the air conditioner in Embodiment 1, in the use-side evaporator unit 1, control is made so that dehumidification is performed up to the absolute humidity that is made to have the target humidity hm at the target temperature Tm and then, if it is determined that the temperature T2 according to the detection of the temperature detector 8 indicating the temperature of the blown-out temperature 16 exceeds the predetermined range and is higher than the target temperature Tm, the correction value X is calculated on the basis of the difference ΔT2 between the target temperature Tm and the temperature T2, and the temperature of the blown-out air 15 on the primary side of the use-side condenser 4 is lowered on the basis of the target intermediate temperature T1*m* corrected by the correction value X, and thus, even if the minimum condensation capability of the use-side condenser 4 is high, for example, the temperature and humidity of the blown-out air 16 can be brought close to the target temperature and target humidity. Thus, a comfortable level of air conditioning can be sought.

Also, the use-side condenser unit 18 that performs reheating heats the blown-out air 15 by heat exchange with the refrigerant or the like in the use-side condenser 4. Thus, there is no need to perform reheating by an electric heater or the like, and an accident such as a fire caused by high temperature of the electric heater can be prevented. Therefore, the reliability of the use-side unit is improved, and since the device does not have to be in a fire-resistant structure, the structure of the use-side unit can be simplified and its size can be reduced.

Embodiment 2

The use-side unit of the above-described Embodiment 1 corrects the target intermediate temperature T1*m* of the blown-out air 15 on the basis of the difference ΔT2 between the temperature T2 of the blown-out air 16 and the target temperature Tm. By means of this correction, the temperature of the blown-out air 15 is lowered, and the temperature of the blown-air 16 is adjusted. Thus, the temperature is given priority over humidity to be brought close to the target. Here, the sucked air 14 is cooled in order to lower the temperature of the blown-out air 15, but if the target intermediate temperature T1*m* (target dew-point temperature Tdwm) of the blown-out air 15 is lowered, humidity might be lowered too much (into the range of (2) in FIG. 4). If the humidity is lowered, the number of occurrence of static electricity is increased, for example. Thus, comfort might be lost more than a case in which the temperature of the air is not controlled.

Figure 5:
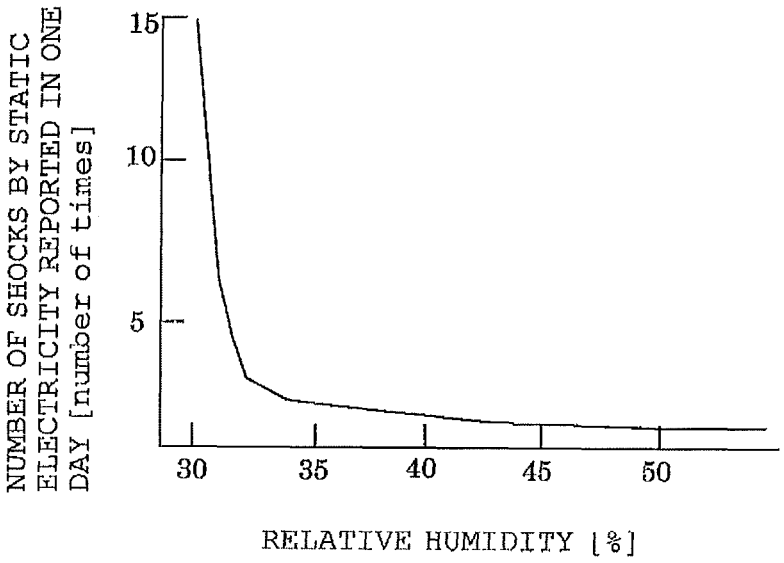
FIG. 5 is a diagram illustrating a relationship between relative humidity and the number of shocks of static electricity.

FIG. 5 is a graph illustrating relative humidity and the number of shocks by static electricity reported in one day. As shown in FIG. 5, if the humidity is lower than 35%, for example, the number of shocks by static electricity is rapidly increased. Thus, if the humidity is kept at 35% or more, the number of shocks by static electricity can be decreased.

Thus, in Embodiment 2, by preventing the humidity from being lowered excessively by correction of the target intermediate temperature T1*m*, the number of shocks by static electricity is decreased, and an air conditioner with higher comfort is provided. Here, since a configuration of the use-side unit according to Embodiment 2 of the present invention is the same as that of Embodiment 1, the devices and the like of the use-side unit will be described using FIG. 1.

Figure 6:
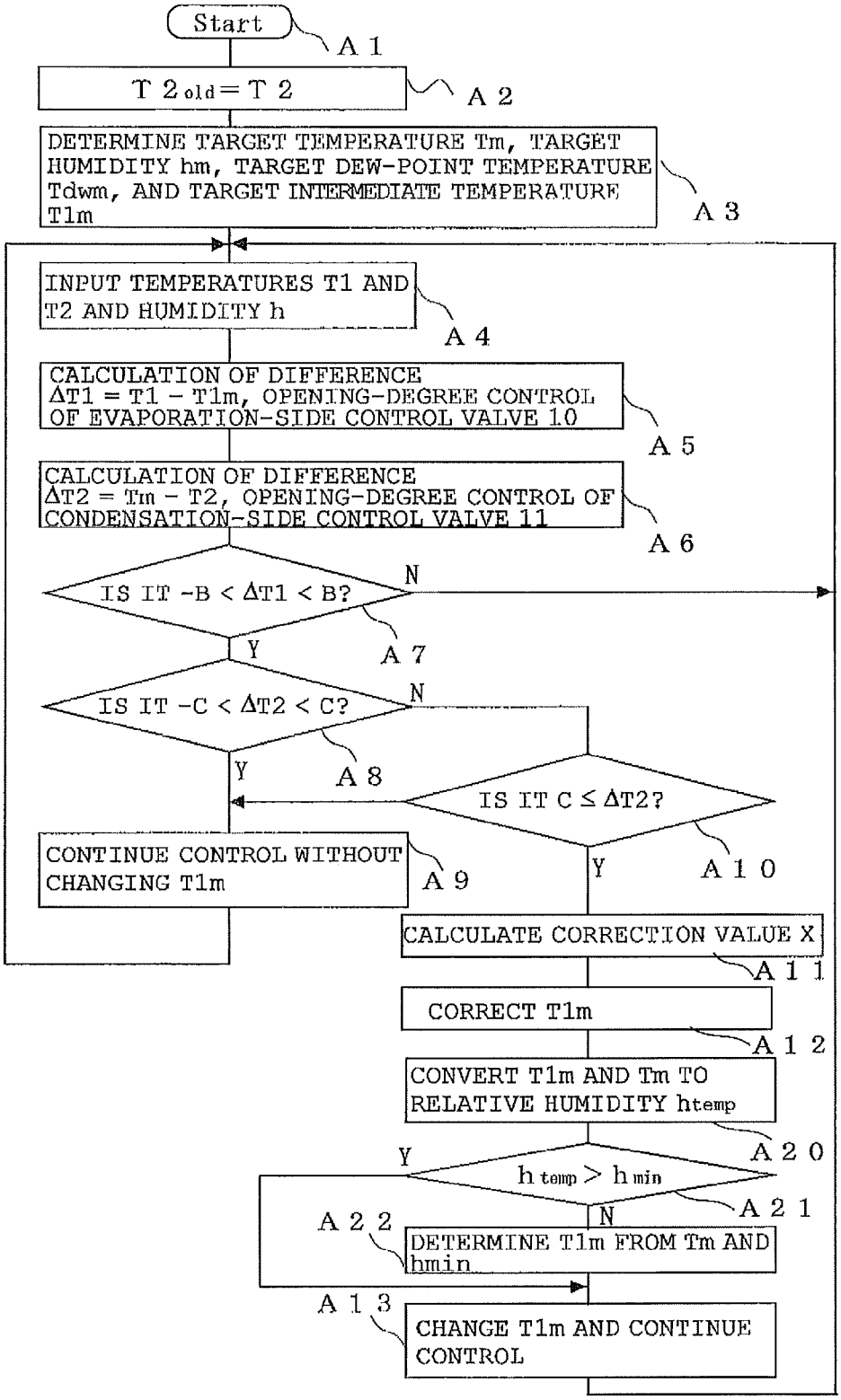
FIG. 6 is a diagram illustrating a flowchart indicating control contents in Embodiment 2.

FIG. 6 is a diagram illustrating a flowchart according to control of air-conditioning processing mainly by the evaporation-side controller 5 (condensation-side controller 6) according to Embodiment 2. The processing at Steps A1 to A12 is the same as in Embodiment 1. Here, in this embodiment, lower-limit humidity $h_{min}$ indicating a lower limit value of humidity is assumed to be set in advance.

The evaporation-side controller 5 makes conversion to relative humidity $h_{temp}$ on the basis of the target intermediate temperature T1*m* corrected by the correction value X at Step A12 and the target temperature Tm (A20). The evaporation-side controller 5 compares the relative humidity $h_{temp}$ with the lower-limit humidity $h_{min}$ and determines if the relative humidity $h_{temp}$ is not less than the lower-limit humidity $h_{min}$ (A21). If it is determined that the relative humidity $h_{temp}$ is not less than the lower-limit humidity $h_{min}$, control is made on the basis of the corrected target intermediate temperature T1*m*. As for the use-side condenser unit 18, control is made so as to maintain the state (A13).

On the other hand, if it is determined that the relative humidity $h_{temp}$ is not at the lower-limit humidity $h_{min}$ or more (the relative humidity $h_{temp}$ is smaller than the lower-limit humidity $h_{min}$), the target intermediate temperature T1*m* is determined on the basis of the target temperature Tm and the lower-limit humidity $h_{min}$ (A22), and control is executed (A13).

Here, as for setting of the above-described lower-limit humidity $h_{min}$, it may be able to be set by inputting an arbitrary numeral value from the remote controller 17 by the user, for example. Alternatively, it may be able to be set by switching the switch disposed in the remote controller 17 or the like.

As described above, in the use-side unit of the air conditioner of Embodiment 2, the lower-limit humidity $h_{min}$ can be set and if it is determined that by correcting the target intermediate temperature T1*m*, the humidity of the blown-out air 16 becomes lower than the lower-limit humidity $h_{min}$, the target intermediate temperature T1*m* is determined on the basis of the lower-limit humidity $h_{min}$, and thus, the humidity of the blown-out air 16 does not fall under the lower-limit humidity $h_{min}$. Thus, occurrence of static electricity can be suppressed, for example, and comfort in the space to be air-conditioned or the like can be sought.

Embodiment 3

Figure 7:
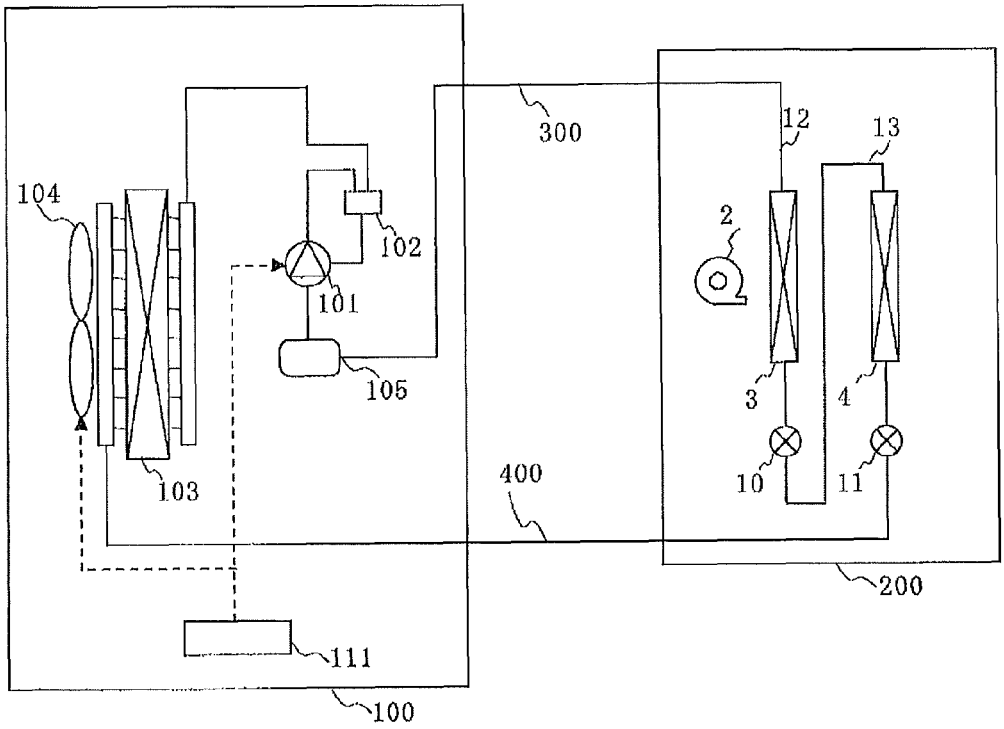
FIG. 7 is a diagram illustrating a configuration example of an air conditioner according to Embodiment 3.

FIG. 7 is a diagram illustrating a configuration example of an air conditioner according to Embodiment 3. The air conditioner in FIG. 7 is provided with a heat-source-side unit (outdoor unit) 100, and a use-side unit (indoor unit) 200 described in Embodiments 1 and 2. They are connected by a refrigerant pipeline and constitute a refrigerant circuit through which the refrigerant is circulated. In the refrigerant pipelines, a pipeline through which a gas refrigerant (a gas refrigerant) flows is referred to as a gas pipeline 300, and a pipeline through which a liquid refrigerant (a liquid refrigerant. It might be a gas-liquid two-phase refrigerant) is referred to as a liquid pipeline 400.

The heat-source-side unit 100 is composed of devices (means) such as a compressor 101, an oil separator 102, a heat-source-side condenser 103, a heat-source-side fan 104, an accumulator 105, and a heat-source-side controller 111 in this embodiment.

The compressor 101 sucks the refrigerant, compresses the refrigerant, makes it in a high-temperature and high-pressure gas state and allows it to flow into the refrigerant pipeline. In the operation control of the compressor 101, for example, by providing an inverter circuit (not shown) or the like in the compressor 101 and by arbitrarily changing an operation frequency, it is assumed that the capacity of the compressor 101 (an amount to feed out the refrigerant in a unit time) can be finely changed.

Also, the oil separator 102 separates lubricating oil mixed in the refrigerant and discharged from the compressor 101. The separated lubricating oil is returned to the compressor 101. Also, the heat-source-side condenser 103 exchanges heat between the refrigerant and the outside air. It exchanges heat between the refrigerant compressed in the compressor 101 and the air and condenses and liquefies the refrigerant. In the heat-source-side condenser 103, a heat-source-side fan 104 is disposed in order to exchanges heat between the refrigerant and the air efficiently. The heat-source-side fan 104 may also have an inverter circuit (not shown) so that the operation frequency of the fan motor is arbitrarily changed and the rotation speed of the fan is finely changed.

The accumulator 105 is means to store an excess liquid refrigerant, for example. The heat-source-side controller 111 is composed of a microcomputer and the like. It can conduct wired or wireless communication with the above-described evaporation-side controller 5 (condensation-side controller 6) and executes operation control of the entire air conditioner by controlling means relating to the air conditioner such as the operation frequency control of the compressor 101 by the inverter circuit control and the like on the basis of the temperature, humidity and the like according to the detection by various detecting means (sensors) in the air conditioner, for example.

On the other hand, in the use-side unit 200 in FIG. 7, the pipelines 12 and 13 are assumed to be connected in series such that the pipeline 13 is located on the upstream side with respect to the flow of the refrigerant. Thus, not only in the heat-source-side condenser 103 but also in the use-side condenser 4, the further condensed refrigerant flows into the use-side evaporator 3.

Subsequently, an operation of the air conditioner will be described on the basis of circulation of the refrigerant in the refrigerant circuit. The high-temperature and high-pressure gas refrigerant discharged from the compressor 101 by a driving operation of the compressor 101 is condensed while passing through the heat-source-side condenser 103, becomes the liquid refrigerant (or the gas-liquid two-phase refrigerant) and flows out of the heat-source-side unit 100. The refrigerant having passed through the liquid pipeline 400 and flowed into the use-side unit 200 passes through the condensation-side control valve 11 and the use-side condenser 4, heats the blown-out air 15, and passes through the evaporation-side control valve 10 and the use-side evaporator 3 and cools and dehumidifies the sucked air 14. The refrigerant having passed through the use-side evaporator 3 is evaporated and flows out. Then, it passes through the gas pipeline 300 and flows into the heat-source-side unit 100, sucked into the compressor 101 and pressurized and discharged again so to be circulated.

Here, the evaporation capability of the use-side evaporator 3 and the condensation capability of the use-side condenser 4 may be changed by adjusting the refrigerant amount discharged from the compressor 101, and changing the refrigerant amount flowing through the use-side evaporator 3 and the use-side condenser 4. As a result, the temperature and humidity of the blown-out air 15 and the blown-out air 16 can be adjusted.

As described above, according to the air conditioner of Embodiment 3, the refrigerant circuit is constituted by connecting the use-side unit 200 described in the above-described Embodiments 1 and 2, the heat-source-side unit 100 having the compressor 101 and the heat-source-side condenser 103 by the gas pipeline 300 and the liquid pipeline 400. Then, the refrigerant is made to flow into the use-side evaporator unit 1 and the use-side condenser unit 18 by the pipelines 12 and 13. Thus, by using the heat amount which should have been wasted by the heat-source condenser 103 of the heat-source-side unit 100 by the cooling and dehumidification by the use-side evaporator unit 1 in the use-side condenser 4 in the use-side condenser unit 18, the blown-out air 15 can be reheated (heated), whereby energy can be saved.

Embodiment 4

In the above-described Embodiments 1 and 2, the case in which the temperature and humidity of the blown-out air 16 are controlled to the target temperature and the target humidity was described, but the present invention can be also used in a case in which the humidity is fixed and only the temperatures of the blown-out air 15 and 16 are controlled to the target temperature, for example.

Also, in the above-described Embodiments 1 and 2, the use-side evaporator 3 and the use-side condenser 4 are provided and the air is cooled (dehumidified) and reheated by heat exchange with a heat conveying medium such as a refrigerant and fed out into the space to be air-conditioned or the like. For example, cooling (dehumidification) and reheating of the air may be performed using another cooling means and heating means.

Embodiment 5

In the above-described Embodiment 3, the heat-source-side condenser 103, which is a heat exchanger of the heat-source-side unit 100, has a condensation function but not limited to that. For example, it may be an evaporator having an evaporation function. Also, a four-way valve or the like, for example, may be provided so that either one of evaporation and condensation can be performed by the flowing-in refrigerant. In these cases, in the use-side unit 200, too, for example, the flow of the refrigerant in the use-side unit 200 needs to be changed by changing a pipeline connected to the one different from that in FIG. 7, by enabling switching and the like.

Also, in Embodiment 3, the use-side evaporator 3 and the use-side condenser 4 are connected by a pipeline in series in the same refrigerant circuit, but they may be different refrigerant circuits, respectively.

The invention claimed is:

1. A use-side unit comprising:

an evaporator that recovers moisture obtained by cooling and condensing air to be fed out into a space to be air-conditioned by heat exchange so as to perform dehumidification;

a condenser that heats air having passed the evaporator by heat exchange to feed the air out into said space to be air-conditioned;

a first temperature detector that detects a dry-bulb temperature of the air to be fed out into said space to be air-conditioned;

a second temperature detector that detects a dry-bulb temperature of the air after it has passed through said evaporator but before it has passed through said condenser;

and a controller that calculates a target intermediate dry-bulb temperature that is made to be a dry-bulb temperature target of the air having passed through said evaporator and before having passed through said condenser on the basis of a target dry-bulb temperature and a target relative humidity of the air to be fed out into said space which has passed said condenser, and if it is determined that a difference between the dry-bulb temperature of the air to be fed out into said space according to the detection of said first temperature detector and said target dry-bulb temperature is larger than or equal to a predetermined value, the controller calculates a correction value on the basis of the difference between the dry-bulb temperature of the air to be fed out into said space according to the detection of said first temperature detector and said target dry-bulb temperature to correct said target intermediate dry-bulb temperature on the basis of the corrected value in order to adjust the temperature of airflow exiting the evaporator.

2. The use-side unit of claim 1, further comprising:

an evaporation-side control valve that controls a flow rate of a heat conveying medium that exchanges heat with the air passing through said evaporator;

a condensation-side control valve that controls the flow rate of the heat conveying medium that exchanges heat with the air passing through said condenser; and said controller controls an opening-degree of said evaporation-side control valve so that the dry-bulb temperature according to the detection of said second temperature detector is to be said target intermediate dry-bulb temperature and controls the opening-degree of said condensation-side control valve so that the dry-bulb temperature according to the detection of said first temperature detector is to be said target dry-bulb temperature.

3. The use-side unit of claim 2, wherein the controller calculates a difference between the dry-bulb temperature of the air having passed through said evaporator and the target intermediate dry-bulb temperature, and determines whether this difference is within an allowable range.

4. The use-side unit of claim 1, further comprising a storage device that stores a lower limit value for the relative humidity of the air to be fed out into said space to be air-conditioned as data, wherein if said controller determines that the relative humidity of the air at said target intermediate dry-bulb temperature corrected by the calculated correction value is lower than said lower limit value, said controller corrects the target intermediate dry-bulb temperature on the basis of said lower limit value in order to adjust the temperature of the airflow exiting the evaporator.

5. An air conditioner that configures a refrigerant circuit comprising:

the use-side unit of claim 1; and a heat-source-side unit having a compressor that compresses a heat conveying medium and a heat-source-side heat exchanger that condenses said heat conveying medium by heat exchange connected by a pipeline so that said heat conveying medium is circulated, wherein the heat source-side unit is connected to the use-side unit.

6. An air conditioner of claim 5, wherein a flow rate of said heat conveying medium passing through said evaporator and/or said condenser is adjusted by controlling a discharge amount of said heat conveying medium from said compressor.

7. The use-side unit of claim 1, further comprising an input device that sets a dry-bulb temperature and/or relative humidity, wherein said controller determines said target dry-bulb temperature and/or said target relative humidity on the basis of the dry-bulb temperature of the air to be fed out into said space to be air-conditioned and/or relative humidity related to setting.

8. The use-side unit of claim 1, wherein the dry-bulb temperature of the air detected by the second temperature detector is also used by the controller to calculate the correction value.

9. The use-side unit of claim 1, wherein the controller calculates a target dewpoint temperature based on the target dry-bulb temperature and the target relative humidity, and the target dewpoint temperature is set as the target intermediate dry-bulb temperature.

* * * * *